US006056382A

United States Patent [19]

Arad

[11] Patent Number: 6,056,382

[45] **Date of Patent: *May 2, 2000**

[54] FURNITURE PIECE WITH WAVY VERTICAL SUPPORTS

[75] Inventor: Ron Arad, London, United Kingdom

[73] Assignee: Fiam Italia S.p.A., Tavullia, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,691

[22] PCT Filed: Apr. 6, 1995

[86] PCT No.: PCT/IT95/00049

§ 371 Date: Dec. 5, 1997

§ 102(e) Date: Dec. 5, 1997

[87] PCT Pub. No.: WO96/31147

PCT Pub. Date: Oct. 10, 1996

[51] Int. Cl.[7] ..... A47B 88/00

[52] U.S. Cl. ..... 312/351; 312/9.47; 108/106

[58] Field of Search ..... 312/9.47, 9.48, 312/9.53, 9.54, 9.64, 351; 108/106, 107, 110, 147.11

[56] References Cited

U.S. PATENT DOCUMENTS

| | | | |
|---|---|---|---|
| 2,291,185 | 7/1942 | Clouse . | |
| 4,593,642 | 6/1986 | Shay | 114/347 |
| 5,097,946 | 3/1992 | Emrich | 312/9.48 X |
| 5,191,977 | 3/1993 | Markovitz | 312/9.48 X |
| 5,393,135 | 2/1995 | Tisbo et al. | 312/9.48 |
| 5,405,196 | 4/1995 | Shoup et al. | 312/351 |
| 5,549,377 | 8/1996 | Krivec | 312/334.8 |
| 5,642,923 | 7/1997 | Meacham et al. | 108/106 X |
| 5,707,124 | 1/1998 | Johnson et al. | 312/9.47 X |
| 5,791,748 | 8/1998 | Marhefka | 312/9.38 |

FOREIGN PATENT DOCUMENTS

| | | |
|---|---|---|
| 0527658 | 2/1993 | European Pat. Off. . |
| 2409027 | 6/1979 | France . |
| 9420350 | 2/1995 | Germany . |
| 403211 | 6/1966 | Switzerland . |
| 2101881 | 1/1983 | United Kingdom . |

*Primary Examiner*—Peter M. Cuomo
*Assistant Examiner*—Stephen Vu
*Attorney, Agent, or Firm*—Sughrue, Mion, Zinn, Macpeak & Seas, PLLC

[57] ABSTRACT

A piece of furniture includes two vertical members each formed from a wavy sheet of material having alternating parallel horizontal crests and depressions on opposing surfaces thereof. A shelf is supported at opposite ends by bearing gaskets secured to opposite ends of the shelf with each bearing gasket disposed between two successive crests on a respective vertical member.

4 Claims, 4 Drawing Sheets

FURNITURE PIECE WITH WAVY VERTICAL SUPPORTS

BACKGROUND OF THE INVENTION

1. Technical field

The present invention relates to a structure for a piece of furniture and to a piece of furniture including that structure.

2. Background art

There are known pieces of furniture comprising one or more shelves which can be positioned at different heights on uprights provided with suitable support means.

Basically, the support means must be enough strong such as to bear a shelf, including a reasonable load on the shelf. Besides it is often required that the support means allow easy positioning of the shelves, i.e. both allow a certain choice for the height where to position each shelf and allow unlimited removal and repositioning of the shelf.

In general, where easy positioning is required, shelves are simple rectangular boards, while the support means are variously shaped bodies fixed to the uprights and projecting therefrom.

DISCLOSURE OF THE INVENTION

The object of this invention is to provide a structure for a piece of furniture and hence a piece of furniture which allow easy positioning of the shelves.

Therefore, the invention relates to a structure for a piece of furniture, including at least a vertical board forming an upright, at least an horizontal board forming a shelf, and support means for supporting the shelf on the upright at predetermined heights, characterized in that the upright has at least a wavy surface in which parallel horizontal crests and depressions succeed each other, the support means comprising such crests.

With this structure, each shelf is positioned on the upright by inserting the edge of the shelf in any of the depressions of the surface, with a drawer-like operation. Once inserted, the edge of the shelf rests onto the underlying crest.

The support for each shelf provided by a crest of the wavy surface of the upright is particularly strong, since it is not confined to a number of points but rather it is extended to the whole length of the edge of the shelf. Moreover, the easy positioning of the shelf is ensured by the very simple drawer-like operation for inserting and removing it, as well as by the very high number of positions available for the height of each shelf.

In a piece of furniture, each upright may support shelves on one side only or on both sides. Thus, preferably, both surfaces of the upright are equally wavy, the vertical board being itself wavy as a whole, shaped according to a succession of waves. This allows to use the upright in case support of shelves either on only one side or on both sides is required.

Moreover, shaping a whole board according to a wave is in general simpler than shaping only one surface thereof. In fact, with most materials a wavy board can be obtained by deformation of a flat board, while obtaining only a wavy surface and leaving the other surface flat generally requires machining of the board, by milling or the like.

The shelf can rest directly onto the crest of the upright. Preferably, however, the shelf is provided with a bearing gasket along its edge intended to be supported by the crests of the upright. The gasket can perform several useful tasks, such as to ensure high friction and avoid slipping, or to conform the shelf to the exact shape of the wave without having to shape the edge of the shelf itself, or to smooth the contact between the shelf and the upright, or even to avoid direct contact between the upright and the shelf if such a contact can cause problems.

In a particularly interesting embodiment of the invention, the vertical and horizontal boards are made of glass and the bearing gasket is made of a resilient material—preferably transparent—adhered to the edge of the board. In fact, in case of pieces of furniture integrally made with glass, the invention allows to have effective support means without having to introduce support elements of different material, which would affect the aestetic impact of the whole-glass structure. The resilient gasket (which is practically invisible if made with transparent material such as silicone rubber or the like) avoids possible damages to the glass even when the shelf is handled without care.

A structure according to the invention can be advantageously used for making various pieces of furniture, in which there are several uprights and shelves. Not necessarily all of the uprights are made according to the invention, it being well possible to have in the same piece of furniture uprights according to the invention and conventional uprights.

In a specific aspect, the invention relates to a piece of furniture, including a base, a top, at least two vertical boards forming respective uprights fixed to the base and the top, at least an horizontal board forming a shelf, and support means for supporting the shelf on the uprights at predetermined heights, characterized in that the uprights have wavy opposing surfaces in which parallel horizontal crests and depressions succeed each other, the support means comprising such crests.

Preferably, both surfaces of the uprights are equally wavy, the vertical boards being itself wavy as a whole, shaped according to a succession of waves.

Preferably, the shelf is provided with bearing gaskets along its edges intended to be supported by the crests of the uprights.

Preferably, the vertical and horizontal boards are made of glass and the bearing gaskets are made of a resilient material adhered to the edges of the board.

MODES FOR CARRYING OUT THE INVENTION

Figure 1:
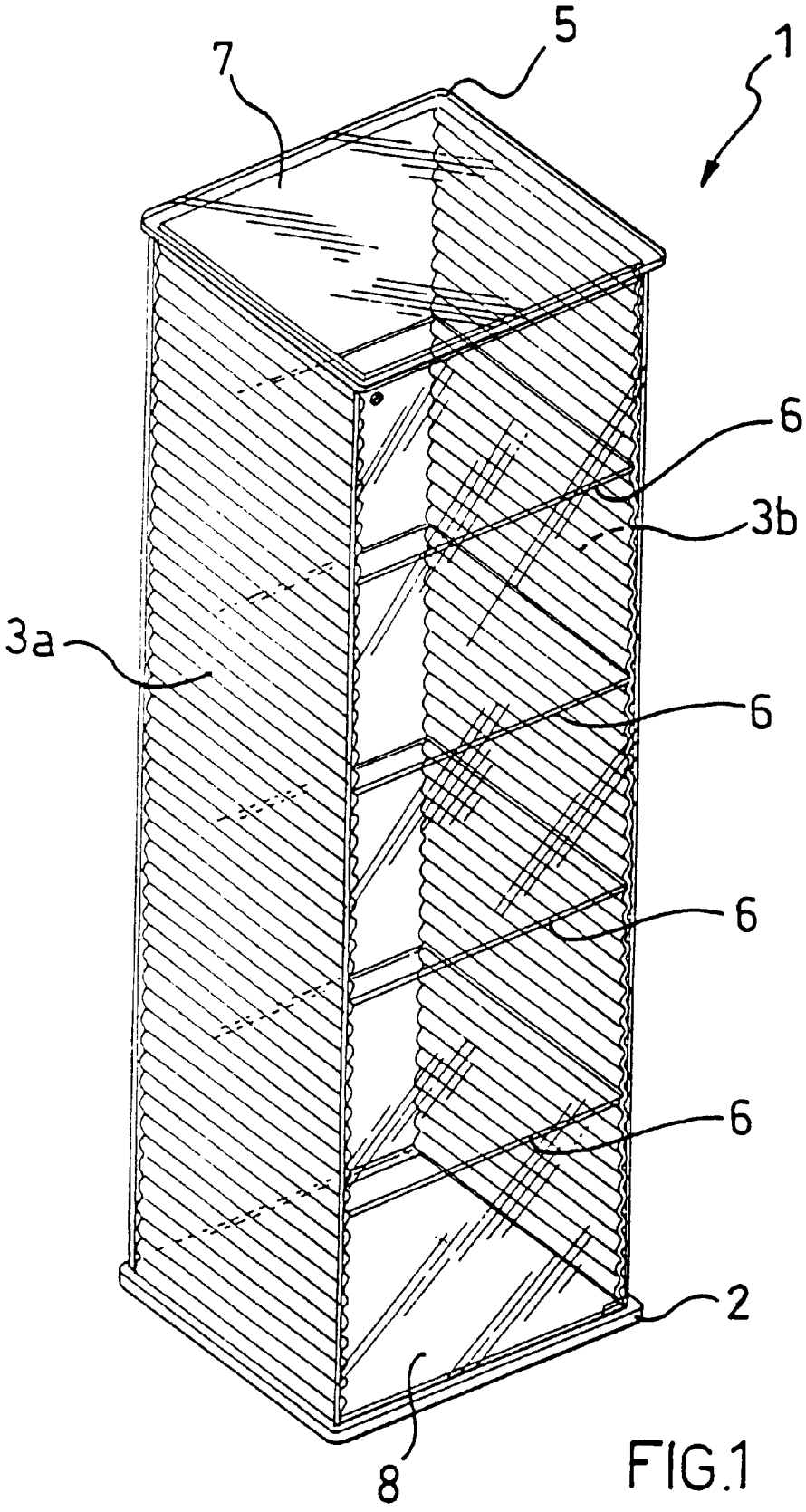
FIG. 1 is a perspective view of a piece of furniture—namely a bookcase—according to the invention.

A piece of furniture 1, in particular a bookcase, includes an horizontal base 2 intended to rest on a floor, two vertical uprights 3*a* and 3*b*, a top 5 and some shelves 6. The uprights 3*a* and 3*b* are fixed to the base 2 and to the top 5 so as to form a solid body. Optionally, the piece of furniture may include also a back 7 and a front door 8.

The uprights 3*a* and 3*b* comprise respective vertical boards 9*a* and 9*b* and each shelf comprises a respective horizontal board 11, the indications vertical and horizontal being referred to the normal position of use of the piece of furniture 1.

The vertical boards 9*a* and 9*b* of the uprights 3*a* and 3*b* are wavy, i.e. are shaped according to a succession of waves including crests and depressions.

More precisely, the surface of the board 9*a* opposing the board 9*b* and correspondingly the surface of the board 9*b* opposing the board 9*a* are provided with parallel horizontal crests—all indicated with 12—and depressions—all indicated with 13—which succeed each other. The indication "crest" or "depression" is referred to a specific surface or side of the board, being clear that where there is a crest on a side of a board there is a depression on the other side of the same board.

The shape of the wavy boards 9*a* and 9*b* is preferably that of a sinusoidal wave, having a pitch of 40 to 80 mm. The waves of the two uprights 3*a* and 3*b* are in phase opposition, i.e. the crests 12 of the board 9*a* facing the board 9*b* are at the same height as the crests 12 of the board 9*b* facing the board 9*a,* as well as the depressions 13 of the board 9*a* facing the board 9*b* are at the same height as the depressions 13 of the board 9*b* facing the board 9*a.*

The wavy shape of the boards 9*a* and 9*b,* and in particular the crests 12, operate as support means for the shelves 6, whose horizontal boards 11 have width which is greater than the free width between two opposing crests 12 and smaller than the free width between two opposing depressions 13. In this way, the shelves 6 can be inserted in the depressions 13, being supported by the crests 12 in correspondence of edges 14 of the boards 11.

The edges 14 are advantageously provided with bearing gaskets 15, made of resilient material such as silicone rubber or the like. Gaskets 15 are fixed to the boards by gluing or the like.

Figure 2:
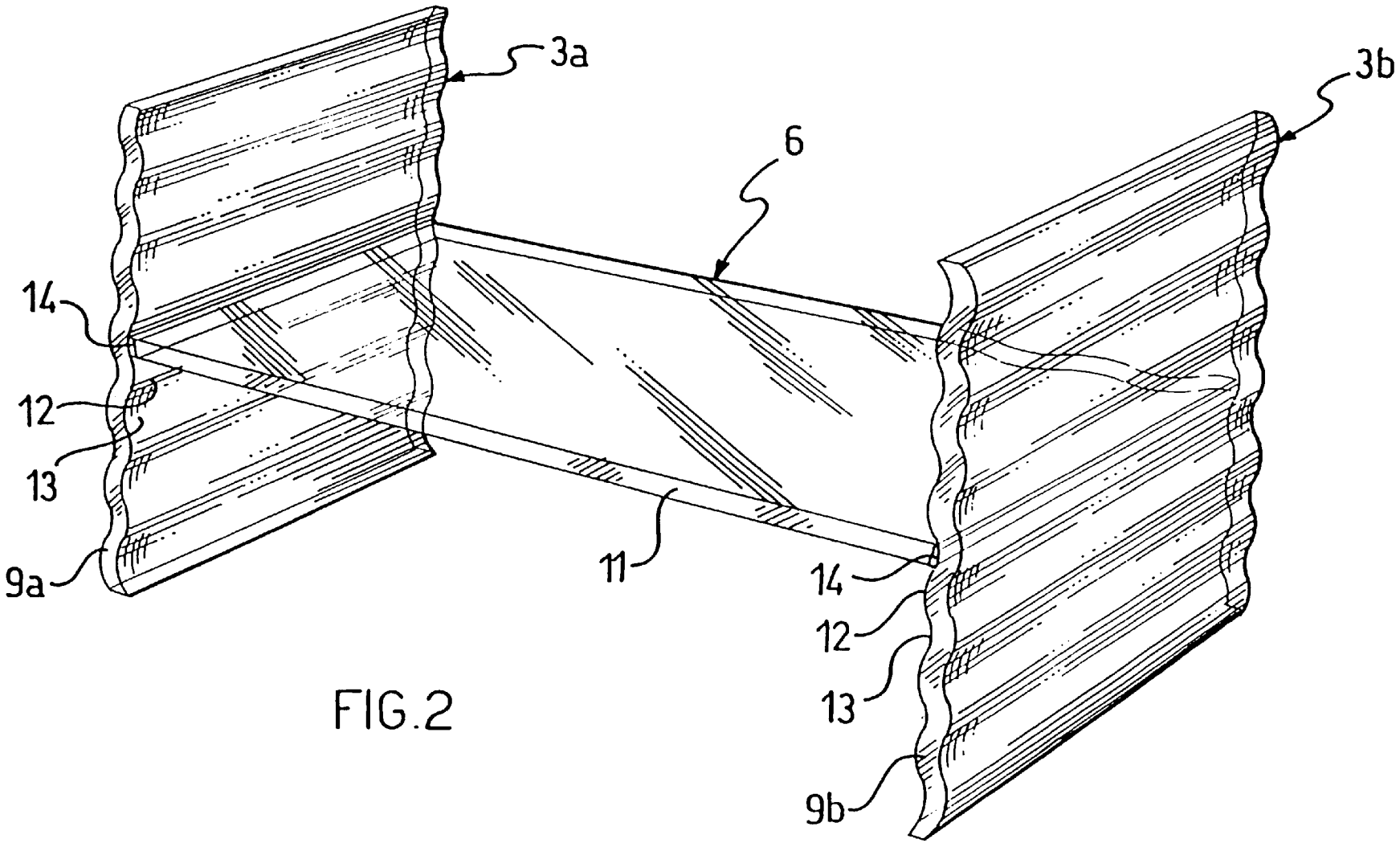
FIG. 2 is an enlarged scale perspective view of a detail of the bookcase of FIG. 1.
Figure 3:
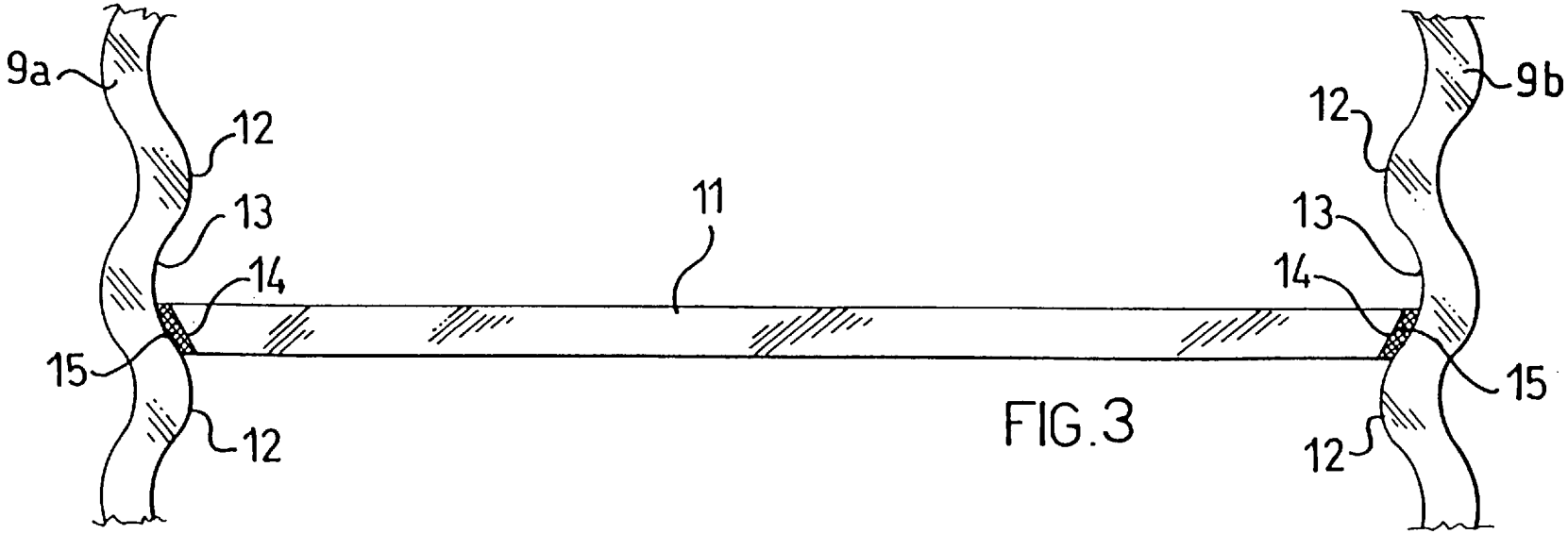
FIG. 3 is a front view of the detail of FIG. 2.

In the preferred embodiment shown in FIGS. 1 to 3, the edges 14 of the boards 11 are bevelled, to give a better resting on the inclined surface of the crests 12. In this case, the gasket 15 has an inclined section, matching the inclination of the edges 14 and the crests 12.

Figure 4:
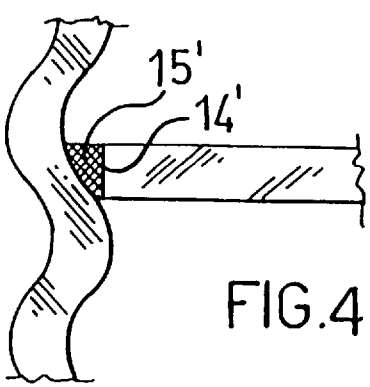

Alternatively, in a second embodiment shown in FIG. 4, the edges 14' have no bevelling and are provided with gaskets 15' having triangular or trapezoidal section. Shaping of the board 11 is simpler, but support may be not enough strong.

Figure 5:
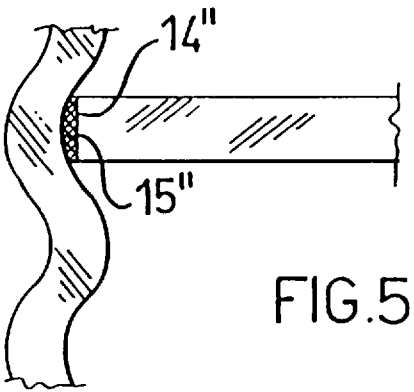

A third embodiment shown in FIG. 5 provides for the same shape for the edges 14" , i.e. without bevelling, while the gaskets 15" have the shape of a circular segment, thus allowing positioning of the shelf 6 about the middle of the depression 13. Such positioning may be more stable, although removal and repositioning of the shelf become more difficult.

Figure 6:
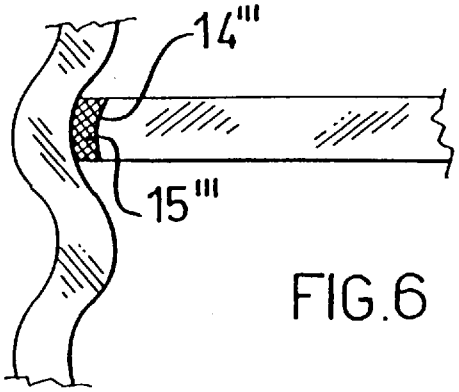
FIGS. 4 to 6 show the same detail in three alternative embodiments.

In a fourth embodiment shown in FIG. 6 the edges 14"' are rounded; the gaskets 15"' have an arcuate shape, to match the edges 14"' and the crests 12. Also in this case, the shelf 6 is positioned about the middle of the depression 13. This embodiment is substantially equivalent to the previous one, with a more complicated shaping of the board 11.

Figure 7:
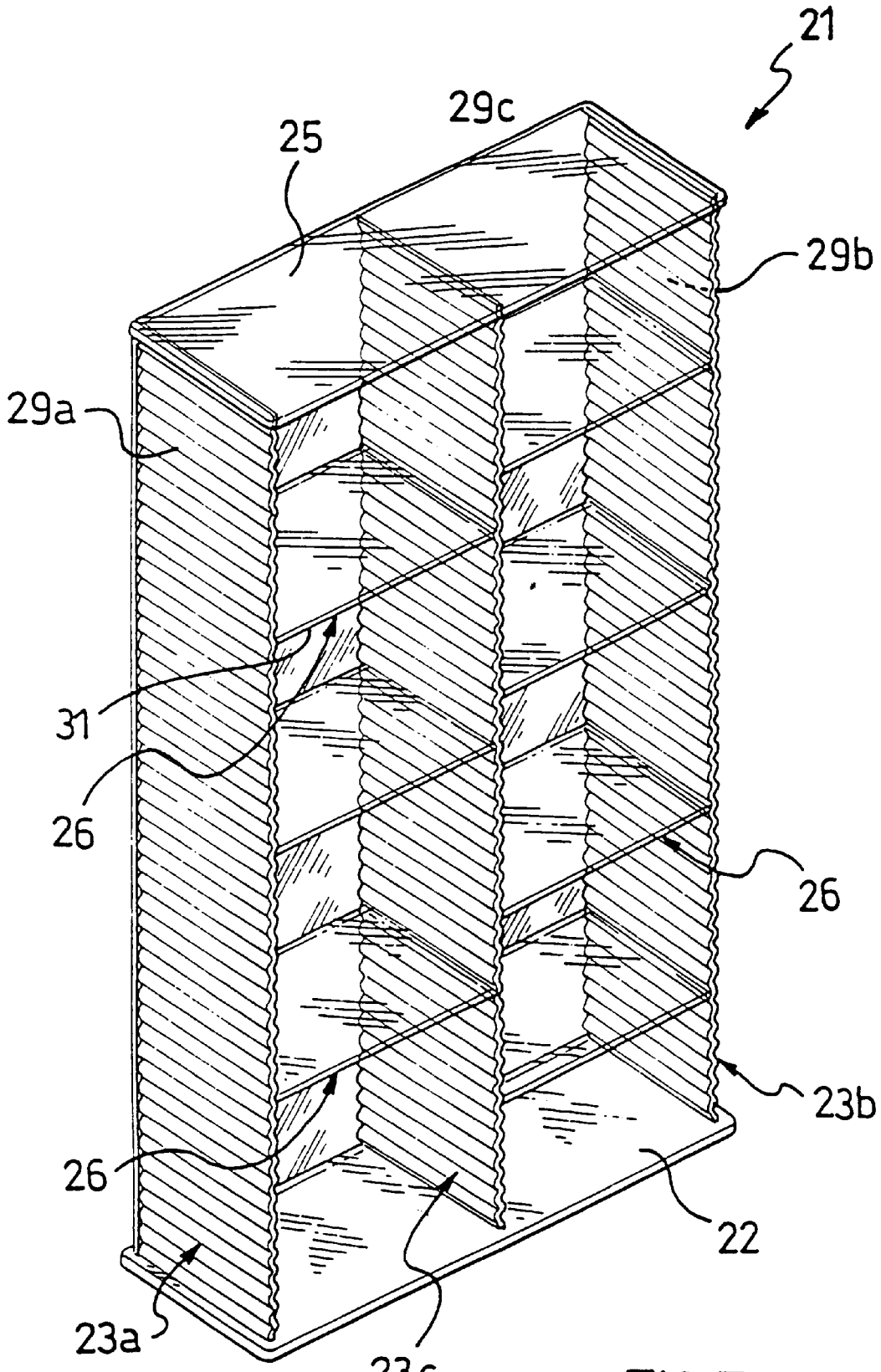
FIG. 7 is a perspective view of another piece of furniture—again a bookcase—according to the invention.

Another piece of furniture is shown at 21 in FIG. 7. The piece of furniture 21 (again a bookcase) includes an horizontal base 22 intended to rest on a floor, three vertical uprights 23*a,* 23*b* and 23*c,* a top 25 and some shelves 26. The uprights 23*a,* 23*b* and 23*c* are fixed to the base 22 and to the top 25 so as to form a solid body.

Uprights 23*a,* 23*b* and 23*c* have the same characteristics as uprights 3*a* and 3*b* of the piece of furniture 1, i.e. comprise wavy vertical boards 29*a* and 29*b* with crests 32 and depressions 33. Similarly, shelves 26 have the the same characteristics as shelves 6 of the piece of furniture 1, i.e. comprise rectangular horizontal boards 31.

In the piece of furniture 21 it should be noted that upright 23*c* supports shelves 26 on both surfaces.

In a piece of furniture according to the invention, support of the shelves is particularly strong, being extended to the whole length of the edges of the shelves.

Besides, positioning of the shelves is very easy. Indeed, the height where to put a shelf can be selected among a very high number of possibilities, and removal and repositioning of a shelf can be easily performed with a drawer-like operation.

Pieces of furniture 1 and 21 as shown are made of glass, in the sense that all vertical and horizontal boards as well as the bases and the tops are made of glass; only gaskets are made of a transparent polimeric material, preferably silicone rubber. Manufacturing of the wavy vertical boards can be performed by starting from a flat board, laying it onto a grid formed by a succession of rods, heating it to the temperature where the glass begins to soften and to deform around the rods, and cooling it as soon as the desired shape is obtained. Fixing of the bases and tops to the uprights can be performed by tonguing and gluing.

In glass furniture the invention will be particularly appreciated, since it allows to avoid the use of unaesthetic joints to support the shelves.

What is claimed is:

1. A structure for a piece of furniture comprising at least one vertical board forming an upright, at least one horizontal board forming a shelf, support means for supporting the shelf on the upright at a predetermined height, wherein said upright is made of glass and has equally wavy opposing surfaces with alternating horizontal crests and depressions on said opposing surfaces with the crests on one surface being offset vertically with respect to the crests on an opposing surface, said support means are comprised of said crests and said vertical board is wavy over the entire length of the vertical board, wherein the shelf is supported on the vertical board by the interposition of a bearing gasket secured to an end edge of the shelf and having a thickness substantially equal to the thickness of the shelf, the bearing gasket is disposed between two of said successive crests of the vertical board and has limited contact with the vertical board and the shelf.

2. The structure according to claim 1, wherein said at least one horizontal board is made of glass and the bearing gasket is made of a resilient material adhered to an end edge of the horizontal board.

3. A piece of furniture comprising a base, a top and at least two vertical boards forming respective uprights fixed to the base and the top, at least one horizontal board forming a shelf, support means for supporting the shelf on the upright at a predetermined height, wherein the uprights are made of glass and have equally wavy opposing surfaces with alternating parallel horizontal crests and depressions on said opposing surfaces with the crests on one surface being offset vertically with respect to the crests on an opposing surface, said support means are comprised of said crests and said vertical boards are wavy over the entire length of the vertical boards, wherein the shelf is supported on the vertical boards by the interposition of bearing gaskets secured to opposite end edges of the shelf and having a thickness substantially equal to the thickness of the shelf, the bearing gaskets being disposed between two successive crests of each vertical board and having limited contact zones with the vertical boards and the shelf.

4. The structure according to claim 3, wherein the at least one horizontal board is made of glass and the bearing gaskets are made of a resilient material adhered to the opposite end edges of the horizontal board.

* * * * *